United States Patent [19]

Yokoi et al.

[11] Patent Number: 4,672,939

[45] Date of Patent: Jun. 16, 1987

[54] INTAKE MANIFOLD FOR INTERNAL COMBUSTION ENGINE HAVING EXHAUST GAS RECIRCULATION SYSTEM

[75] Inventors: Tatsuhisa Yokoi, Toyota; Eisaku Takeya, Nishikamo; Kyo Hattori, Toyota; Kazuo Abe, Susono; Hideyuki Osawa, Oobu, all of Japan

[73] Assignees: Toyota Jidosha Kabushiki Kaisha, Toyota; Kabushiki Kaisha Toyoda Jidoshokki Seisakusho, Kariya, both of Japan

[21] Appl. No.: 766,784

[22] Filed: Aug. 19, 1985

[30] Foreign Application Priority Data

Sep. 29, 1984 [JP] Japan ..... 59-147736[U]

[51] Int. Cl.[4] ..... F02M 25/06

[52] U.S. Cl. ..... 123/568; 123/569

[58] Field of Search ..... 123/52 M, 568, 569, 123/570, 571, 572, 573

[56] References Cited

U.S. PATENT DOCUMENTS

| | | | |
|---|---|---|---|
| 3,135,253 | 6/1964 | Mühlberg | 123/569 |
| 4,031,873 | 6/1977 | Banzhaf et al. | 123/568 X |
| 4,222,356 | 9/1980 | Ueda et al. | 123/568 |
| 4,327,699 | 5/1982 | Reiff et al. | 123/568 |
| 4,398,525 | 8/1983 | Ahrns et al. | 123/569 X |
| 4,461,150 | 7/1984 | Grohn | 123/568 X |
| 4,517,951 | 5/1985 | Otaka et al. | 123/568 |

FOREIGN PATENT DOCUMENTS

| | | |
|---|---|---|
| 0088933 | 7/1981 | Japan . |
| 0088934 | 7/1981 | Japan . |
| 0033713 | 3/1983 | Japan . |
| 0065922 | 4/1983 | Japan . |
| 0116748 | 8/1983 | Japan . |

*Primary Examiner*—Willis R. Wolfe, Jr.

*Attorney, Agent, or Firm*—Cushman, Darby & Cushman

[57] ABSTRACT

An intake manifold (2) for an internal combustion engine equipped with an exhaust gas recirculation (EGR) system capable of recirculation a part of the exhaust gas to the intake system, having a configuration capable of preventing oil contained in the blow-by gas supplied by a positive crankcase ventilation (PCV) system or the air supplied by a turbocharger from flowing into the EGR gas outlet (10) of the EGR system opened to the intake manifold (2). The EGR outlet (10) is formed in the upper section of the interior of the intake manifold (2) so that the flow of oil into the EGR gas outlet (10) is impeded.

3 Claims, 8 Drawing Figures

INTAKE MANIFOLD FOR INTERNAL COMBUSTION ENGINE HAVING EXHAUST GAS RECIRCULATION SYSTEM

BACKGROUND OF THE INVENTION

1. Field of the Invention

The present invention relates to an internal combustion engine equipped with an exhaust gas recirculation (EGR) system. More specifically, it relates to an intake manifold for such an internal combustion engine, capable of preventing the deposition of combustion products around the EGR gas outlet of the exhaust gas recirculation system.

2.Description of the Related Art

In an ordinary internal combustion engine, unburnt hydrocarbons (abbreviated to "HC" hereinafter) leak through the clearances between the piston and the piston rings into the crankcase of the engine due to a so-called pumping action of the piston rings during reciprocating operation of the piston. The discharge of HC (generally referred to as "the blow-by gas") into the atmosphere causes air pollution. Therefore, it is usual to feed the blow-by gas through the cylinder head into the intake manifold, where the blow-by gas mixes with the intake air or fuel-air mixture. A system for introducing the blow-by gas into the intake manifold is generally referred to as a positive crankcase ventilation system (abbreviated to "PCV system" hereinafter).

On the other hand, in some internal combustion engines, before discharging the exhaust gas into the atmosphere, a part of the exhaust gas (EGR gas) is circulated through the intake system to reduce the concentration of nitrogen oxides (abbreviated to "NOx" hereinafter) in the discharged exhaust gas. In such an exhaust gas recirculation systems, especially for a Diesel engine, EGR gas contains relatively large amount of combustion products, such as carbon particles. On the other hand, in a PCV system as mentioned above, oil vapor contained in the blow-by gas is brought from the crankcase through the cylinder head and head cover into the intake manifold in which the oil flows in a mist or film-like condition. Under these circumstances, the carbon particles contained in the EGR gas are trapped by the oil flowing from the PCV system into the intake manifold and adhered to the inner surface of the intake manifold. These particles, hereinafter referred to as "deposits", grow in the vicinity of the EGR pipe (the EGR gas inlet of the intake manifold), thereby these deposits may block the outlet of the EGR pipe. In an engine equipped with a turbocharger, bearing lubrication oil in a turbin housing will leak to the intake manifold, so that the amount of oil flowing therein is increased, thereby the above-mentioned problems will readily arise.

Techniques have been proposed to reduce the collection of deposits around the outlet of the EGR pipe. Such known techniques are, for example; projecting the outlet of an EGR pipe into the interior of an intake manifold (Japanese Unexamined Utility Model Publication Nos. 56-88933 and 58-116748), disposing the outlet of an EGR pipe and the outlet of the pipe of a PCV system symmetrically with respect to the center axis of the throttle valve (Japanese Unexamined Patent Publication No. 58-65922); providing a blow-by gas guide for guiding the blow-by gas to the downstream of the outlet of the EGR pipe (Japanese Unexamined Utility Model Publication No. 56-88934); or projecting a blow-by gas pipe of a PCV system into the interior of an intake manifold (Japanese Utility Model Publication No. 58-33713).

SUMMARY OF THE INVENTION

An object of the present invention is to provide an intake manifold having a simple construction for an internal combustion engine equipped with an EGR system, the interior of the manifold being provided with means for preventing the oil vapor and the like from flowing into the EGR gas outlet of the EGR pipe, thereby preventing the deposition of deposits around the exhaust gas outlet to secure a necessary exhaust gas recirculating rate (abbreviated to "EGR rate" hereinafter).

According to the present invention, an intake manifold for an internal combustion engine is provided equipped with an EGR system for introducing a part of the exhaust gas from an exhaust passage through an exhaust (EGR) gas outlet into the intake manifold, characterized in that the exhaust (EGR) gas outlet is provided in the upper section of the interior thereof.

DESCRIPTION OF THE PREFERRED EMBODIMENTS

Figure 4:
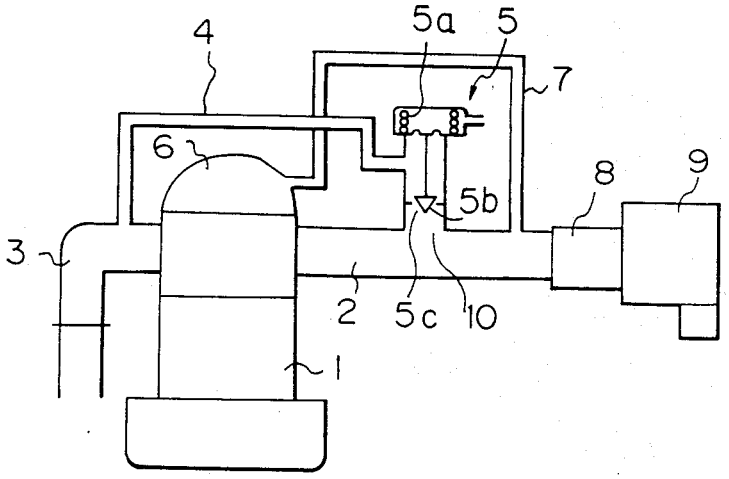
Fig. 4 PRIOR ART
FIG. 4 is a schematic illustration generally showing an internal combustion engine equipped with an EGR system.

The present invention will be described hereinafter with reference to the preferred embodiments thereof in conjunction with the accompanying drawings. First, referring to FIG. 4, indicated at 1 is an internal combustion engine; 2, an intake manifold; and 3, an exhaust manifold. The intake manifold 2 and the exhaust manifold 3 are connected to each other by means of an exhaust gas recirculation pipe 4 (abbreviated to "EGR pipe" hereinafter) and an exhaust gas recirculation valves (abbreviated to "EGR valve" hereinafter). The valve element 5*c* of the EGR valve 5 is operated to open or close an inlet 5*c* by the mutual functions of the intake manifold pressure and the resilient force of a spring 5*a*. A part of exhaust gas (EGR gas) is fed through an EGR gas outlet 10 into the intake manifold 2. The intake manifold 2 is connected to the interior of a cylinder head cover 6 by means of a positive crankcase ventilation pipe (abbreviated to "PCV pipe" hereinafter) 7 which opens into the intake manifold 2 at a position upstream of the EGR gas outlet 10. An air cleaner 9 is connected to the intake manifold 2 by a hose 8. Such an engine including EGR and PCV systems is already known in the prior art.

Figure 5:
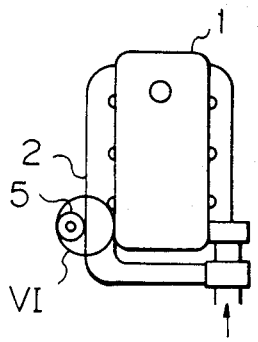
Fig. 5 PRIOR ART
FIG. 5 is a plan view of the internal combustion engine as shown in FIG. 4.
Figure 6:
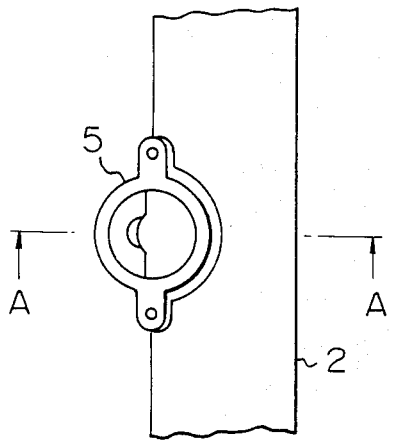
FIG. 6 is an enlarged fragmentary plan view of a portion of FIG. 5 indicated by a symbol VI.
Figure 7:
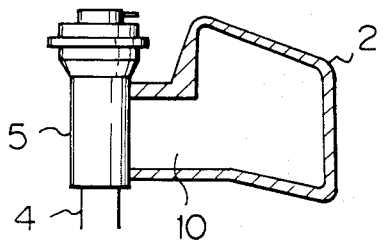
Fig. 7 PRIOR ART
FIG. 7 is a partial cross-sectional view, corresponding to a cross-sectional view taken along line A—A of FIG. 6, but illustrating an exhaust (EGR) gas outlet and its vicinity, in a conventional EGR system.

FIG. 5 is a top plan view of the internal combustion engine as mounted on a vehicle; FIG. 6 is a fragmentary enlarged view of a portion indicated by a symbol VI in FIG. 5; and FIG. 7 is a sectional view of an internal combustion engine equipped with a conventional intake manifold and a conventional EGR system, taken along line A—A of FIG. 6. As shown in FIG. 7, the EGR gas outlet 10 of the conventional EGR system known in the prior art is provided on the side wall of the intake manifold 2. Consequently, the oil vapor contained in the blow-by gas supplied to the intake manifold 2 by the PCV system or leaked from a turbocharger into the intake manifold 2 flows to a point downstream in the intake manifold; however, the oil cannot be separated properly from the EGR gas fed into the intake manifold 2, and hence deposits are liable to collect around the EGR gas outlet 10.

Figure 1A:
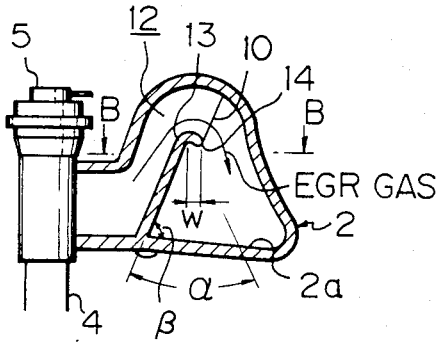
FIG. 1A is a partial cross-sectional view, corresponding to a cross-sectional view taken along line A—A of FIG. 6, but illustrating an embodiment of the present invention.
Figure 2:
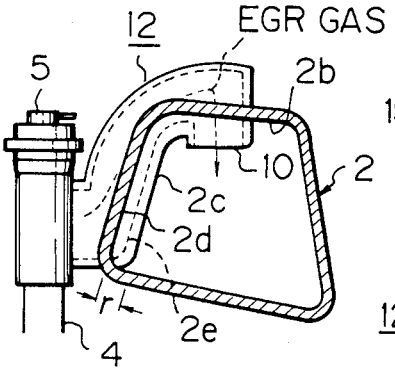
FIGS. 2 and 3 are partial cross-sectional views, corresponding to the cross-sectional view taken along line A—A of FIG. 6, but illustrating further embodiments of the present invention.
Figure 3:
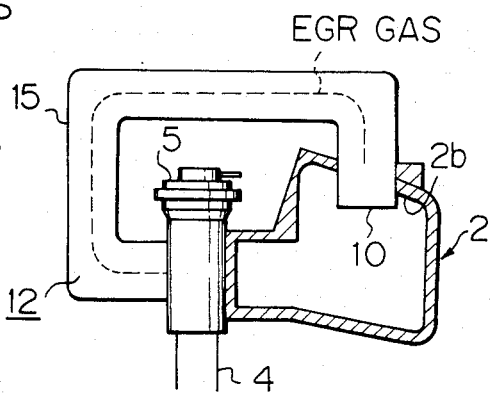

FIGS. 1A, 2, and 3 are sectional views, each corresponding to a sectional view taken along line A—A of FIG. 6, of the intake manifold 2, but illustrating embodiments of the present invention, around the EGR gas outlet of the EGR system, respectively. Similar to the EGR valve 5 of the conventional EGR system shown in FIG. 7, each of EGR valves 5 of these embodiments is disposed beside the side wall of the intake manifolds 2. However, in each embodiment of the present invention, the arrangement of an EGR gas supply passage 12 extending from the EGR valve 5 to the intake manifold 2 and that of an exhaust gas outlet 10 opened to the intake manifold 2 are different from those in the conventional EGR system including the intake manifold shown in FIG. 7.

Figure 1B:
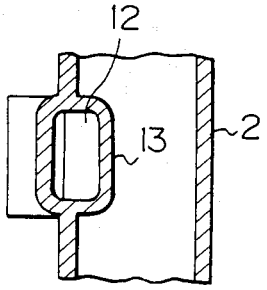
FIG. 1B is a sectional view taken on line B—B of FIG. 1A.

In an embodiment shown FIGS. 1A and 1B, when the intake manifold 2 is made by casting, the EGR gas supply passage 12 is formed integrally with the intake manifold 2 so as to extend into the interior of the intake manifold 2. That is to say, a wall 13 for defining the EGR gas supply passage 12 extends to the upper area of the interior space of the intake manifold 2 to form an EGR gas outlet 10 in the upper area within the intake manifold 2. Preferably, the shape of the cross-section of the EGR gas supply passage 12 is rectangular, as shown in FIG. 1B, so that a sufficient sectional area of the passage 12 is secured even if the EGR system needs to be mounted on the internal combustion engine in a narrow space. It is also preferable to form the EGR gas outlet 10 as wide as possible so that deposits collected around the EGR gas outlet 10 can be readily removed. The upper end of the wall 13, namely, the edge of the wall 13 defining the EGR gas outlet 10, is bent to form a lip 14, as shown in FIG. 1A. Preferably, the width w of the lip 14 in the transverse cross-section of the intake manifold 2 is in the range of 5 to 10 mm and the angle $\alpha$ between the wall 13 and the lip 14 is 90° or less. The preferable angle between the wall 13 and a substantially horizontal bottom wall 2*a* of the intake manifold 2 is also 90° or less. The wall 13 and the lip 14 thus formed cooperate to avoid oil from climbing up along the inner surface (wall 13) of the intake manifold 2.

In another embodiment of the present invention shown in FIG. 2, an EGR gas supply passage 12 is made of a pipe which is joined to an intake manifold 2 so as to extend along the side wall to the top wall of the intake manifold 2. The EGR gas outlet 10 of the EGR gas supply passage 12 is located below the inner surface 2*b* of the top wall of the intake manifold 2 by a small distance (5 to 10 mm) to prevent oil from flowing into the EGR gas outlet 10. A portion 2*c* of the side wall of the intake manifold 2, along which the EGR gas supply passage 12 extends, is concaved along the EGR gas supply passage 12 from the side wall 2*d* of the intake manifold 2 so as to form a step 2*e* therebetween. Therefore, oil flowing along the side wall 2*d* is stopped by the rising surface of the step 2*e* and is prevented from flowing into the EGR gas outlet 10.

In a further embodiment shown in FIG. 3, an EGR valve 5 is contiguous at one side thereof to the side of the intake manifold 2. An EGR gas supply passage 12 is formed by a pipe 15 of a diameter in the range of 20 to 25 mm. The pipe 15 is connected at one end thereof to the other side of the EGR valve 5. The other end of the pipe 15 is extended to the top wall of the intake manifold 2 and protruded from the inner surface 2*b* of the top wall into the interior of the intake manifold 2 by a small distance (5 to 10 mm), similar to the relation between the EGR gas passage 12 and the top wall in the embodiment of FIG. 2. Consequently, oil flowing along the inner wall of the intake passage 2 is prevented from flowing into the EGR gas outlet 10.

According to the present invention, the EGR gas outlet 10 is provided in the upper part of the intake manifold 2 and the EGR gas supply passage is so constructed as to impede the oil from flowing into the EGR gas outlet 10. Accordingly, the EGR gas introduced through the EGR gas supply passage 10 into the intake manifold 2 is well mixed with the intake air, and then flows together with the oil which may be contained in the blow-by gas supplied to the intake manifold 2 by the PCV system or may be leaked into the intake manifold 2 from the turbocharger. Consequently, deposits containing carbon particles and impurities are neither produced nor deposited within the intake manifold, and hence a sufficient EGR rate is secured.

We claim:

1. An intake manifold of an internal combustion engine having an exhaust gas recirculation system which introduces a part of exhaust gas from an exhaust passage through an EGR gas supply passage into said intake manifold, said intake manifold being provided with an EGR gas outlet opened thereto and connected to said EGR gas supply passage, said EGR gas outlet being located in an upper section of an interior of said intake manifold, a part of said EGR gas supply passage, in the vicinity of said EGR gas outlet, extending transversely along a side-to-top wall of said intake manifold, said part of EGR gas passage defining at an opposite side thereof an inclined inner wall along said side-to-top wall of said intake manifold, in a transverse cross-section of said intake manifold, said inclined inner wall having its top portion directed downward to define said EGR gas outlet, so that said EGR gas outlet is defined below an inner surface of the top wall of said inner intake manifold.

2. An intake manifold as set forth in claim 1, wherein said part of said EGR gas supply passage is defined in said intake manifold by a wall portion integrally formed with said intake manifold.

3. An intake manifold as set forth in claim 1, wherein said part of said EGR gas supply passage extends transversely along an outer face of said side-to-top wall of said intake manifold.

* * * * *